US007458646B2

(12) United States Patent
Marathe et al.

(10) Patent No.: US 7,458,646 B2
(45) Date of Patent: Dec. 2, 2008

(54) ROTATABLE CUTTING TOOL AND CUTTING TOOL BODY

(75) Inventors: Anirudda S. Marathe, Bentonville, AR (US); Randall W. Ojanen, Bristol, TN (US); Jonathan W. Bitler, Fayetteville, AR (US); Ray C. MacIntyre, Alum Bank, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 11/544,424

(22) Filed: Oct. 6, 2006

(65) Prior Publication Data

US 2008/0084106 A1 Apr. 10, 2008

(51) Int. Cl.
*E21C 35/18* (2006.01)

(52) U.S. Cl. ..... 299/110

(58) Field of Classification Search ..... 299/110
See application file for complete search history.

(56) References Cited

U.S. PATENT DOCUMENTS 4,201,421 A 5/1980 Den Besten et al.
4,277,106 A * 7/1981 Sahley ..... 299/111
4,484,644 A * 11/1984 Cook et al. ..... 175/420.1

(Continued)

FOREIGN PATENT DOCUMENTS

DE 197 45 164 C2 11/2002

OTHER PUBLICATIONS

Exhibit A—Handwritten sketch of SPRP26B tool body and Wirtgen W6H tool body (2006) [1 page].

(Continued)

*Primary Examiner*—John Kreck
(74) *Attorney, Agent, or Firm*—Michael W. Smith

(57) ABSTRACT

A rotatable cutting tool carried in a bore of a holder wherein the holder has a forward surface surrounding a forward end of the bore. The rotatable cutting tool includes an elongate cutting tool body that has a central longitudinal axis, an axial forward end and an axial rearward end. The cutting tool body contains a socket in the axial forward end thereof whereby the socket receives a hard insert therein. The cutting tool body has an enlarged diameter collar mediate of the axial forward end and the axial rearward end. The mediate collar presents an axial forward facing surface and an axial rearward facing surface. The cutting tool body has an axial forward hardness region beginning at and extending a first pre-selected distance in an axial rearward direction from the axial forward end to encompass the axial forward facing surface of the collar. The axial forward hardness region has a hardness equal to or greater than a first hardness, as well as a first average hardness. The cutting tool body has an axial rearward hardness region beginning at and extending a second pre-selected distance in an axial forward direction from the axial rearward end to encompass an axial rearward section of the shank portion. The axial rearward hardness region has a third average hardness. The cutting tool body has a transition hardness region mediate of and contiguous with the axial forward hardness region and the axial rearward hardness region. The transition hardness region encompasses the axial rearward facing surface of the collar and an axial forward section of the shank portion. The transition hardness region has a second average hardness. The second average hardness is less than the first hardness, and the third average hardness is less than the second average hardness.

16 Claims, 4 Drawing Sheets

U.S. PATENT DOCUMENTS

| | | | | |
|---|---|---|---|---|
| 4,497,520 | A | 2/1985 | Ojanen | |
| 4,844,186 | A | 7/1989 | Beecroft | |
| 4,850,649 | A | 7/1989 | Beach et al. | |
| 4,886,710 | A | 12/1989 | Greenfield | |
| 5,141,289 | A | 8/1992 | Stiffler | |
| 5,536,073 | A | 7/1996 | Sulosky et al. | |
| 5,806,934 | A * | 9/1998 | Massa et al. | 299/111 |
| 6,364,974 | B1 | 4/2002 | Kobasko | |
| 6,375,272 | B1 | 4/2002 | Ojanen | |
| 6,478,383 | B1 | 11/2002 | Ojanen et al. | |
| 6,786,557 | B2 | 9/2004 | Montgomery, Jr. | |

OTHER PUBLICATIONS

Kennametal Report R4732 (Nov. 1999) [9 pages].
Kennametal Laboratory Test Report 4767 (Jun. 26, 2002) [3 pages].
Kennametal Laboratory Test Report 4768 (Jun. 26, 2002) [3 pages].
Kennametal Laboratory Test Report 5388 (Feb. 4, 2004) [2 pages].
Notification of Transmittal of the International Search Report and the Written Opinion of the International Searching Authority for PCT/US07/80180 mailed Apr. 14, 2008, (1 page).
International Search Report for PCT/US07/80180 mailed Apr. 14, 2008 (2 pages).
Written Opinion of the International Searching Authority for PCT/US07/80180 mailed Apr. 14, 2008 (6 pages).

* cited by examiner

ROTATABLE CUTTING TOOL AND CUTTING TOOL BODY

BACKGROUND OF THE INVENTION

The invention pertains to a rotatable cutting tool that is useful for the impingement of earth strata such as, for example, asphaltic roadway material, coal deposits, mineral formations and the like. More specifically, the present invention pertains to a rotatable cutting tool that is useful for the impingement of earth strata, and especially a cutting tool body that is a component of such a rotatable cutting tool. The cutting tool body exhibits improved hardness properties to thereby provide improved performance characteristics (e.g., wear resistance and toughness) for the entire rotatable cutting tool.

Heretofore, rotatable cutting tools have been used to impinge earth strata such as, for example, asphaltic roadway material. U.S. Pat. No. 4,201,421 to Den Besten et al,. and U.S. Pat. No. 4,497,520 B2 to Ojanen are exemplary of rotatable cutting tools used to impinge earth strata, and especially asphaltic roadway material.

Generally speaking, rotatable cutting tools useful to impinge earth strata have an elongate cutting tool body typically made from steel and a hard tip (or insert) affixed to the cutting tool body at the axial forward end thereof. The hard tip is typically made from a hard material such as, for example, cemented (cobalt) tungsten carbide. The rotatable cutting tool is rotatably retained or held in the bore of a tool holder such as shown in U.S. Pat. No. 6,478,383 to Ojanen et al. In the alternative, the rotatable cutting tool is retained in the bore of a sleeve that is, in turn, held in the bore of a holder such a shown in U.S. Pat. No. 6,786,557 to Montgomery, Jr.

The holder is affixed to a driven member such as, for example, a driven drum of a road milling machine. In some designs, the driven member (e.g., road milling drum) carries hundreds of holders wherein each holder carries a rotatable cutting tool. Hence, the driven member may carry hundreds of rotatable cutting tools. The driven member is driven (e.g., rotated) in such a fashion so that the hard tip of each one of the rotatable cutting tools impinges or impacts the earth strata (e.g., asphaltic roadway material) thereby fracturing and breaking up the material into debris. U.S. Pat. No. 5,536,073 to Sulosky et al. is exemplary of a road milling drum.

As can be appreciated, rotatable cutting tools that impinge earth strata such as asphaltic roadway material operate in a severe environment. The severe operational environment subjects the components of the rotatable cutting tool to both severe abrasive wear and severe stress.

In order to provide an improved useful tool life, it would be desirable to provide a cutting tool body that would exhibit improved resistance to abrasive wear. A more wear-resistant cutting tool body would be better able to withstand severe wear conditions, and thereby would be less likely to experience premature failure due to premature (or excessive) wear.

In order to provide an improved useful tool life, it would be desirable to provide a cutting tool body that would exhibit improved toughness. A tougher cutting tool body would be better able to withstand severe operating conditions, and thereby would be less likely to experience premature failure (e.g., catastrophic stress fracturing) due to operational stress.

As one can appreciate, if a cutting tool body does not exhibit sufficient wear resistance and/or toughness, there exists the risk that the cutting tool body may prematurely fail. Such a premature failure of the cutting tool body is an undesirable result that typically leads to the termination of the useful life of the rotatable cutting tool, as well as a decrease in the operational efficiency of the road milling machine. Overall, it thus is apparent that it would be very desirable to provide an improved rotatable cutting tool that has an improved cutting tool body wherein the cutting tool body exhibits improved wear resistance and improved toughness.

SUMMARY OF THE INVENTION

In one form thereof, the invention is an elongate rotatable cutting tool body with a central longitudinal axis. The tool body comprises an axial forward end and an axial rearward end. The cutting tool body also has a head portion, a shank portion and a collar portion wherein the collar portion is mediate of and contiguous with the head portion and the shank portion. The head portion is adjacent to the axial forward end, and the shank portion is adjacent to the axial rearward end. The cutting tool body has an axial forward hardness region beginning at and extending a first pre-selected distance in an axial rearward direction from the axial forward end to encompass the entire head portion and at least an axial forward section of the collar portion. The axial forward hardness region has a hardness equal to or greater than a first hardness, as well as a first average hardness. The cutting tool body has an axial rearward hardness region beginning at and extending a second pre-selected distance in an axial forward direction from the axial rearward end to encompass an axial rearward section of the shank portion. The axial rearward hardness region has a third average hardness. The cutting tool body also has a transition hardness region mediate of and contiguous with the axial forward hardness region and the axial rearward hardness region. The transition hardness region encompasses an axial rearward section of the collar portion and an axial forward section of the shank portion. The transition hardness region has a second average hardness. The second average hardness is less than the first hardness, and the third average hardness is less than the second average hardness.

In still another form thereof, the invention is a elongate rotatable cutting tool body having a central longitudinal axis. The cutting tool body comprises an axial forward end and an axial rearward end. The cutting tool body has an enlarged diameter collar mediate of the axial forward end and the axial rearward end wherein the mediate collar presents an axial forward facing surface and an axial rearward facing surface. The cutting tool body has an axial forward hardness region beginning at and extending a first pre-selected distance in an axial rearward direction from the axial forward end to encompass the axial forward facing surface of the collar. The axial forward hardness region has a hardness equal to or greater than a first hardness, as well as a first average hardness. The cutting tool body has an axial rearward hardness region beginning at and extending a second pre-selected distance in an axial forward direction from the axial rearward end to encompass an axial rearward section of the shank portion. The axial rearward hardness region has a third average hardness. The cutting tool body has a transition hardness region mediate of and contiguous with the axial forward hardness region and the axial rearward hardness region. The transition hardness region encompasses the axial rearward facing surface of the collar and an axial forward section of the shank portion. The transition hardness region has a second average hardness. The second average hardness is less than the first hardness. The third average hardness is less than the second average hardness.

In still another form, the invention is a rotatable cutting tool carried in a bore of a holder wherein the holder has a forward surface surrounding a forward end of the bore. The rotatable cutting tool includes an elongate cutting tool body that has a central longitudinal axis, an axial forward end and an axial rearward end. The cutting tool body contains a socket in the axial forward end thereof whereby the socket receives a hard insert therein. The cutting tool body has an enlarged diameter collar mediate of the axial forward end and the axial rearward end. The mediate collar presents an axial forward facing surface and an axial rearward facing surface. The cutting tool body has an axial forward hardness region beginning at and extending a first pre-selected distance in an axial rearward direction from the axial forward end to encompass the axial forward facing surface of the collar. The axial forward hardness region has a hardness equal to or greater than a first hardness, as well as a first average hardness. The cutting tool body has an axial rearward hardness region beginning at and extending a second pre-selected distance in an axial forward direction from the axial rearward end to encompass an axial rearward section of the shank portion. The axial rearward hardness region has a third average hardness. The cutting tool body has a transition hardness region mediate of and contiguous with the axial forward hardness region and the axial rearward hardness region. The transition hardness region encompasses the axial rearward facing surface of the collar and an axial forward section of the shank portion. The transition hardness region has a second average hardness. The second average hardness is less than the first hardness, and the third average hardness is less than the second average hardness.

BRIEF DESCRIPTION OF THE DRAWINGS

The following is a brief description of the drawings that form a part of this patent application.

DETAILED DESCRIPTION OF THE INVENTION

Figure 1:
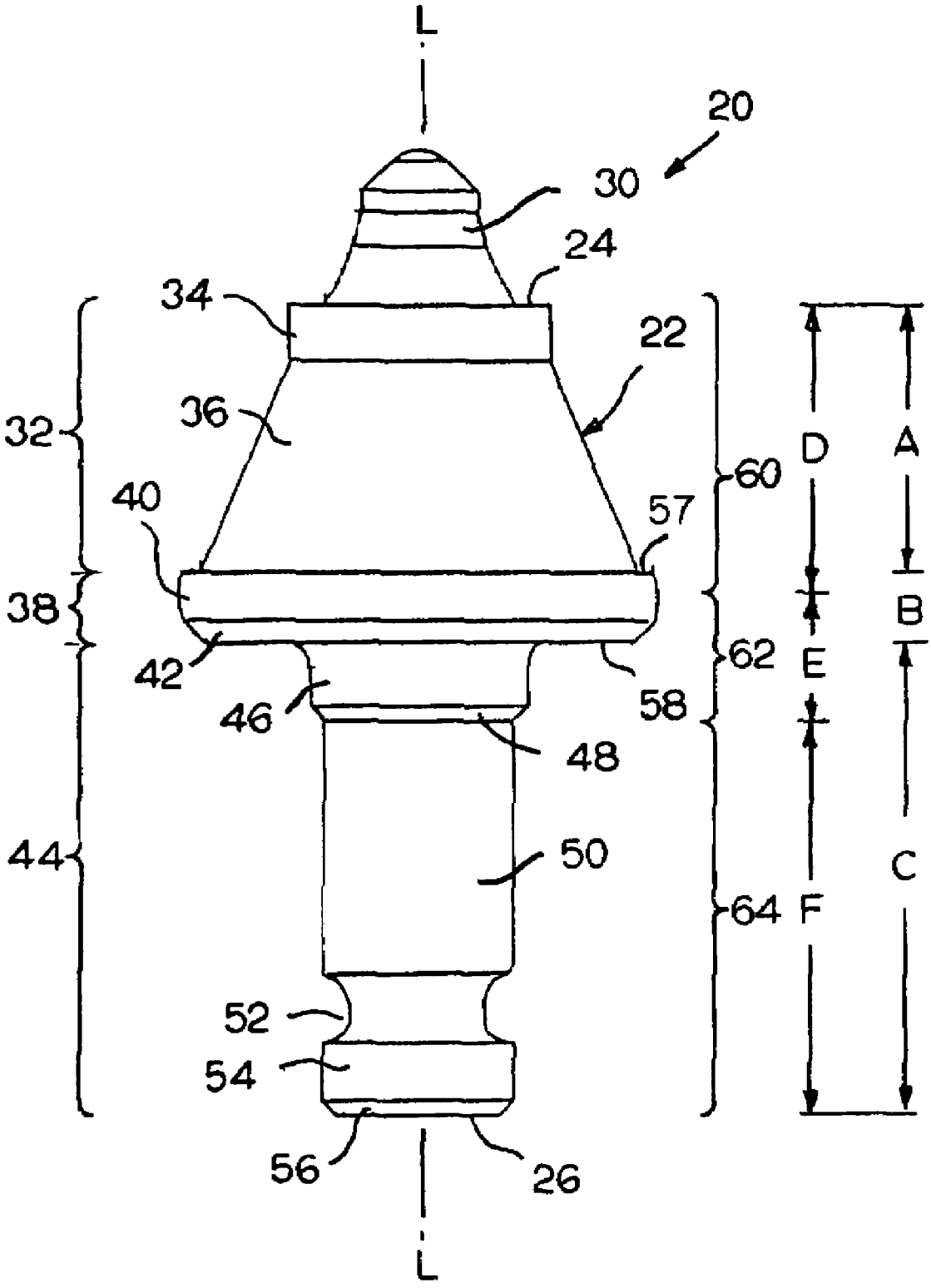
FIG. 1 is a side view of one specific embodiment of a rotatable cutting tool showing the cutting tool body with the hard insert affixed thereto, but without the washer and the retainer attached thereto.

Referring to the drawings, FIG. 1 illustrates one specific embodiment of a rotatable cutting tool generally designated as 20. Rotatable cutting tool 20 comprises an elongate cutting tool body generally designated as 22. The cutting tool body 22 is typically made from steel such as those grades disclosed in U.S. Pat. No. 4,886,710 to Greenfield, which is hereby incorporated by reference herein. Grade 15B37H Modified is the preferred grade of steel for the cutting tool body 22. Grade 15B37H Modified has the following nominal composition (in weight percent): 0.33-0.38% carbon, 1.10-1.35% manganese, 0.0005% minimum boron, 0.15-0.30% silicon, 0.045% maximum sulfur, 0.035% maximum phosphorus and the balance iron. Grade 15B37H Modified has a minimum hardenability equal to about 52 HRc.

The cutting tool body 22 has an axial forward end 24 and an axial rearward end 26. A hard insert 30 is affixed (such as by brazing or the like) in a socket (not illustrated) in the axial forward end 24 of the cutting tool body 22. Hard insert 30 is typically made from cemented carbide such as, for example, cobalt cemented tungsten carbide wherein U.S. Pat. No. 6,375,272 to Ojanen discloses acceptable grades of cemented (cobalt) tungsten carbide. The geometry of the hard insert 30 can vary depending upon the specific application. U.S. Pat. No. 4,497,520 B2 to Ojanen and U.S. Pat. No. 6,375,272 to Ojanen each disclose an exemplary geometry for the hard insert. It should be appreciated that as an alternative to the socket, the axial forward end of the cutting tool body may present a projection that is received within a socket in the bottom of the hard tip. This alternate structure can be along the lines of that disclosed in U.S. Pat. No. 5,141,289 to Stiffler wherein this patent is hereby incorporated by reference herein. Applicant points out that U.S. Pat. No. 5,141,289 also discloses braze alloys that typically are used to braze the hard tip to the socket in the cutting tool body.

The cutting tool body 22 is divided into three principal portions; namely, a head portion, a collar portion and a shank portion. These portions will now be described.

The most axial forward portion is a head portion (see bracket 32). Beginning at the axial forward end 24 and extending along longitudinal axis L-L in the axial rearward direction for a distance A, the head portion 32 comprises a cylindrical section 34 followed by a frusto-conical section 36. As one can appreciate, the transverse dimension (or diameter) of the frusto-conical section 36 increases as the frusto-conical section 36 moves in an axial rearward direction.

The mediate portion is the collar portion (see bracket 38). Beginning at the juncture with the head portion 32 and extending along the longitudinal axis L-L in the axial rearward direction for a distance B, the collar portion 38 comprises a cylindrical section 40 followed by a beveled section 42. The collar portion 38 has an axial forward facing surface 57 and an axial rearward facing surface 58. It should be appreciated that the cylindrical section 40 presents the maximum transverse diameter (or diameter) of the cutting tool body 22.

The most axial rearward portion is the shank portion (see bracket 44). Beginning at the juncture with the collar portion 38 and extending along the longitudinal axis L-L in the axial rearward direction for a distance C, the shank portion 44 comprises a generally cylindrical section 46 followed by a beveled section 48 followed by a forward cylindrical tail section 50, followed by a retainer groove 52 followed by a rearward cylindrical tail section 54 and terminating in a beveled section 56. As is known by those skilled in the art, the shank portion 44 is the portion of the cutting tool body 22 that carries the retainer (not illustrated). The retainer rotatably retains the rotatable cutting tool in the bore of the holder (or the bore of the sleeve carried by a holder). While the retainer can take on any one of many geometries, a retainer suitable for use with this cutting tool body is shown and described in U.S. Pat. No. 4,850,649 to Beach et al.

The cutting tool body 22 presents a hardness profile such that there are three hardness regions; namely, an axial forward hardness region, a transition hardness region, and an axial rearward hardness region. Each one of these hardness regions will be described in more detail hereinafter.

In reference to the axial forward hardness region (see bracket 60), this region begins at and extends along the longitudinal axis L-L in the axial rearward direction a distance D. It should be appreciated that axial distance D is greater than axial distance A, which is the axial length of the head portion 32. What this means is that the axial forward hardness region 60 extends in the axial direction to such an extent to encompass the entire head portion 32, as well as an axial forward section of the collar portion 38. FIG. 1 shows that the axial rearward termination of the bracket 60 is mediate of the axial forward facing surface 57 and the axial rearward facing surface 58 of the collar portion 38. It is apparent that by encompassing the axial forward section of the collar portion 38, the axial forward hardness region 60 encompasses the axial forward facing surface 57 of the collar portion 38.

The axial forward hardness region 60 of the cutting tool body 22 has a minimum first hardness value. In other words, every part of the axial forward hardness region 60 exhibits a hardness value greater than or equal to the minimum (or first) hardness. The minimum (or first) hardness value is pre-selected in that the appropriate part of the cutting tool body 22 (i.e., the axial forward hardness region) can be manufactured to have a hardness equal to or greater than this minimum (or first) hardness. In general, a surface with a higher hardness will possess a greater wear resistance. Hence, by making the head portion 32 with a hardness greater than the pre-selected minimum (or first) hardness, the head portion 32 one provides pre-selected minimum wear resistance properties. Since the head portion 32 typically experiences the greatest abrasive wear during operation, it is desirable to provide the rotatable cutting tool with a head portion that has a higher hardness.

In reference to the transition hardness region (see bracket 62), this region begins at the juncture between the axial forward hardness region 60 and the transition hardness region 62 and extends along the longitudinal axis L-L in the axial rearward direction a distance E. It should be appreciated that axial distance E is of such a length that the transition hardness region 62 has its axial rearward termination in the shank portion 44. By doing so, the transition hardness region 62 encompasses an axial rearward section of the collar portion 38 and an axial forward section of the shank portion 44. It is also apparent that the transition hardness region 62 also encompasses the axial rearward facing surface 58 of the collar portion 38.

The transition hardness region 62 has hardness values within a selected range, as well as a second average hardness. The second average hardness of the transition hardness region 62 is less than the first average hardness of the axial forward hardness region 60. The hardness of transition hardness region 62 is less than or equal to the minimum hardness of the axial forward hardness region 60. In general, the hardness of the transition hardness region 62 decreases in the axial rearward direction.

In reference to the axial rearward hardness region (see bracket 64), this region begins at the juncture between the transition hardness region 62 and the axial rearward hardness region 64 and extends along central longitudinal axis L-L a distance F to the axial rearward end 26 of the cutting tool body 22.

The axial rearward hardness region 64 has hardness values within a pre-selected range, as well as a third average hardness, which is less than the second average hardness. The hardness of the axial rearward hardness region 64 may on occasion overlap the hardness in the transition hardness region 62; however, in general, the hardness in the axial rearward hardness region 64 is less than or equal to the hardness in the transition hardness region 62. In general, the hardness of the axial rearward region 64 can decease in the axial rearward direction. However, it should be appreciated that the portion of the cutting tool body 22 in the vicinity of the retainer groove 52 could have the lowest hardness value of any location on the cutting tool body 22.

As can be appreciated, the shank portion 44 experiences extreme stress (or load) during operation in a severe environment. Since the shank portion 44 has a lower pre-selected average hardness, the shank portion 44 displays an increased level of toughness. Such a level of toughness will allow the shank portion to withstand the stresses it undergoes during operation in a severe environment. It is thus desirable to provide a rotatable cutting tool with a shank portion that has toughness to withstand operational stresses.

The transition hardness region 62 provides for a gradual transition in hardness between the axial forward hardness region 60, which provides for desirable wear-resistance, and the axial rearward hardness region 64, which provides for desirable toughness. Such a gradual transition eliminates a sudden change in hardness and thereby helps maintain the integrity of the rotatable cutting tool during operation.

Figure 2:
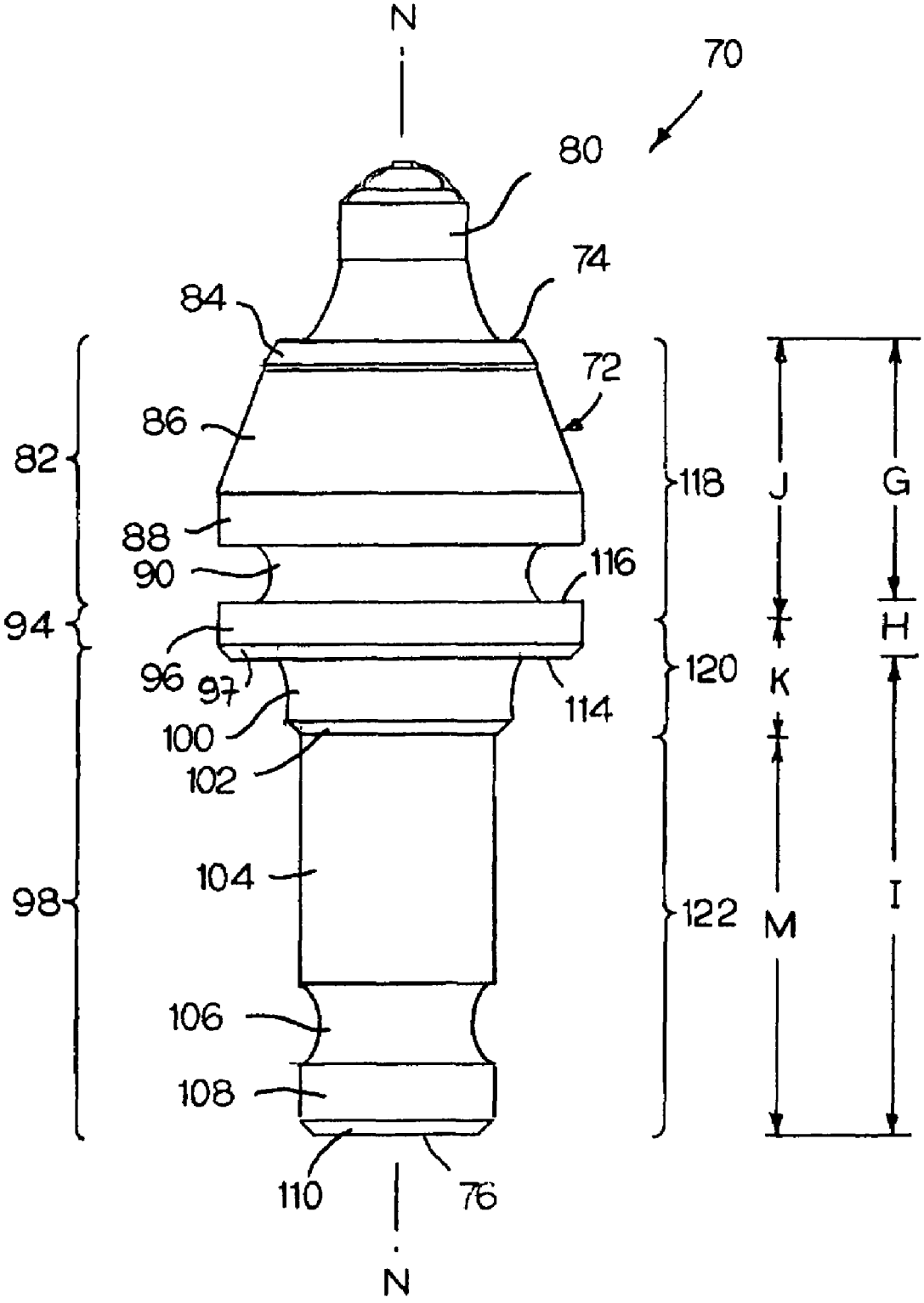
FIG. 2 is a side view of another specific embodiment of the rotatable cutting tool showing the cutting tool body with the hard insert affixed thereto, but without the washer and the retainer attached thereto.

Referring to the drawings, FIG. 2 illustrates a second specific embodiment of a rotatable cutting tool generally designated as 70. Rotatable cutting tool 70 comprises an elongate cutting tool body generally designated as 72. The cutting tool body 72 is typically made from steel such as those grades described in connection with the first specific embodiment hereinabove.

The cutting tool body 72 has an axial forward end 74 and an axial rearward end 76. A hard insert 80 is affixed (such as by brazing or the like) in a socket (not illustrated) in the axial forward end 74 of the cutting tool body 72. Hard insert 80 is typically made from cemented carbide such as those grades described above in connection with the first specific embodiment. The geometry of the hard insert 80 can vary depending upon the specific application such as described above in connection with the first specific embodiment.

The cutting tool body 72 is divided into three principal portions; namely, a head portion, a collar portion and a shank portion. These portions will now be described.

The most axial forward portion is a head portion (see bracket 82). Beginning at the axial forward end 74 and extending along central longitudinal axis N-N in the axial rearward direction for a distance G, the head portion 82 comprises the following sections: a frusto-conical section 84 followed by another frusto-conical section 86 followed by a cylindrical section 88 and ending in a puller groove 90.

The mediate portion is the collar portion (see bracket 94). Beginning at the juncture with the head portion 82 (i.e., the axial forward facing surface 116) and extending along the longitudinal axis N-N in the axial rearward direction a distance H, the collar portion 94 comprises a cylindrical section 96 followed by a beveled section 97. The collar portion 94 has an axial forward facing surface 116 and an axial rearward facing surface 114.

It is apparent that the cylindrical section 88 and the cylindrical section 96 each present the maximum transverse dimension of the cutting tool body 72. The puller groove 90 separates the cylindrical sections (88 and 96). The puller groove functions in conjunction with a puller tool to extract the rotatable cutting tool from the bore of the holder (or the bore of the sleeve). A puller tool is known to those skilled in the art.

The most axial rearward portion is the shank portion (see bracket 98). Beginning at the juncture with the collar portion 94 and extending along the longitudinal axis N-N in the axial rearward direction a distance I, the shank portion 98 comprises a cylindrical section 100 followed by a beveled section 102 followed by a forward cylindrical tail section 104, followed by a retainer groove 106 followed by a rearward cylindrical tail section 108 and terminating in a beveled section 110. Retainers useful in conjunction win cutting tool body 22 are also useful in conjunction with cutting tool body 72.

The cutting tool body 72 presents a hardness profile such that there are three hardness regions; namely, an axial forward hardness region, a transition hardness region, and an axial rearward hardness region. Each one of these hardness regions will be described in more detail hereinafter.

In reference to the axial forward hardness region (see bracket 118), this region begins at the axial forward end 74 and extends along longitudinal axis N-N in the axial rearward direction a distance J. It should be appreciated that axial distance J is greater than axial distance G, which is the axial length of the head portion 82. What this means is that the axial forward hardness region 118 extends in the axial direction to such an extent to encompass the entire head portion 82, as well as an axial forward section of the collar portion 94. FIG. 2 shows that the axial rearward termination of the bracket 118 is mediate of the axial forward facing surface 116 and the axial rearward facing surface 114 of the collar portion 94. It is apparent that by encompassing the axial forward section of collar 94, the axial forward hardness region 118 encompasses the axial forward facing surface 116 of the collar portion 94.

The axial forward hardness region 118 of the cutting tool body 72 has a minimum first hardness value. In other words, every part of the axial forward hardness region 118 exhibits a hardness value greater than or equal to the minimum (or first) hardness. The minimum (or first) hardness value is pre-selected in that the appropriate part of the cutting tool body 72 (i.e., the axial forward hardness region) can be manufactured to have a hardness equal to or greater than this minimum (or first) hardness. In general, a surface with a higher hardness possesses greater wear resistance. Hence, by making the head portion 82 with its hardness greater than the pre-selected minimum (or first) hardness, the head portion 82 exhibits pre-selected minimum wear resistance properties for the rotatable cutting tool 70.

In reference to the transition hardness region (see bracket 120), this region begins at the juncture between the axial forward hardness region 118, and the transition hardness region 120 and extends along longitudinal axis N-N in the axial rearward direction a distance K. It should be appreciated that axial distance K is of such a length that the transition hardness region 120 has its axial rearward termination in the shank portion 98. By doing so, the transition hardness region 120 encompasses an axial rearward section of the collar portion 94 and an axial forward section of the shank portion 98. It is also apparent that the transition hardness region 120 also encompasses the axial rearward facing surface 114 of the collar portion 94.

The transition hardness region 120 has hardness values within a selected range, as well as a second average hardness. The second average hardness of the transition hardness region 120 is less than the first average hardness of the axial forward hardness region 118. The hardness of the transition hardness region 120 is less than or equal to the minimum hardness of the axial forward hardness region 118. In general, the hardness of the transition hardness region 120 decreases in the axial rearward direction.

In reference to the axial rearward hardness region (see bracket 122), this region begins at the juncture between the transition hardness region 120 and the axial rearward hardness region 122 and extends along the longitudinal axis N-N a distance M to the axial rearward end 76 of the cutting tool body 72.

The axial rearward hardness region 122 has hardness values within a selected hardness range, as well as a third average hardness, which is less than the second average hardness. The hardness of the axial rearward hardness region 122 may on occasion overlap the hardness in the transition hardness region 120; however, in general, the hardness in the axial rearward hardness region 122 is less than or equal to the hardness in the transition hardness region 120. In general, the hardness of the axial rearward region 122 can decease in the axial rearward direction. However, it should be appreciated that the portion of the cutting tool body 72 in the vicinity of the retainer groove 106 could have the lowest hardness value of any location on the cutting tool body 72.

As can be appreciated, the shank portion 98 experiences extreme stress during operation in a severe environment. Since the shank portion 98 has a lower pre-selected average hardness, the shank portion 98 displays an increased level of toughness. Such a level of toughness will allow the shank portion to withstand the stresses it undergoes during operation in a severe environment. It is thus desirable to provide a rotatable cutting tool with a shank portion that has a toughness to withstand the operational stresses.

The transition hardness region 120 provides for a gradual transition in hardness between the axial forward hardness region 118, which provides for desirable wear-resistance, and the axial rearward hardness region 122, which provides for desirable toughness. Such a gradual transition eliminates a sudden change in hardness and thereby helps maintain the integrity of the rotatable cutting tool during operation.

Figure 3:
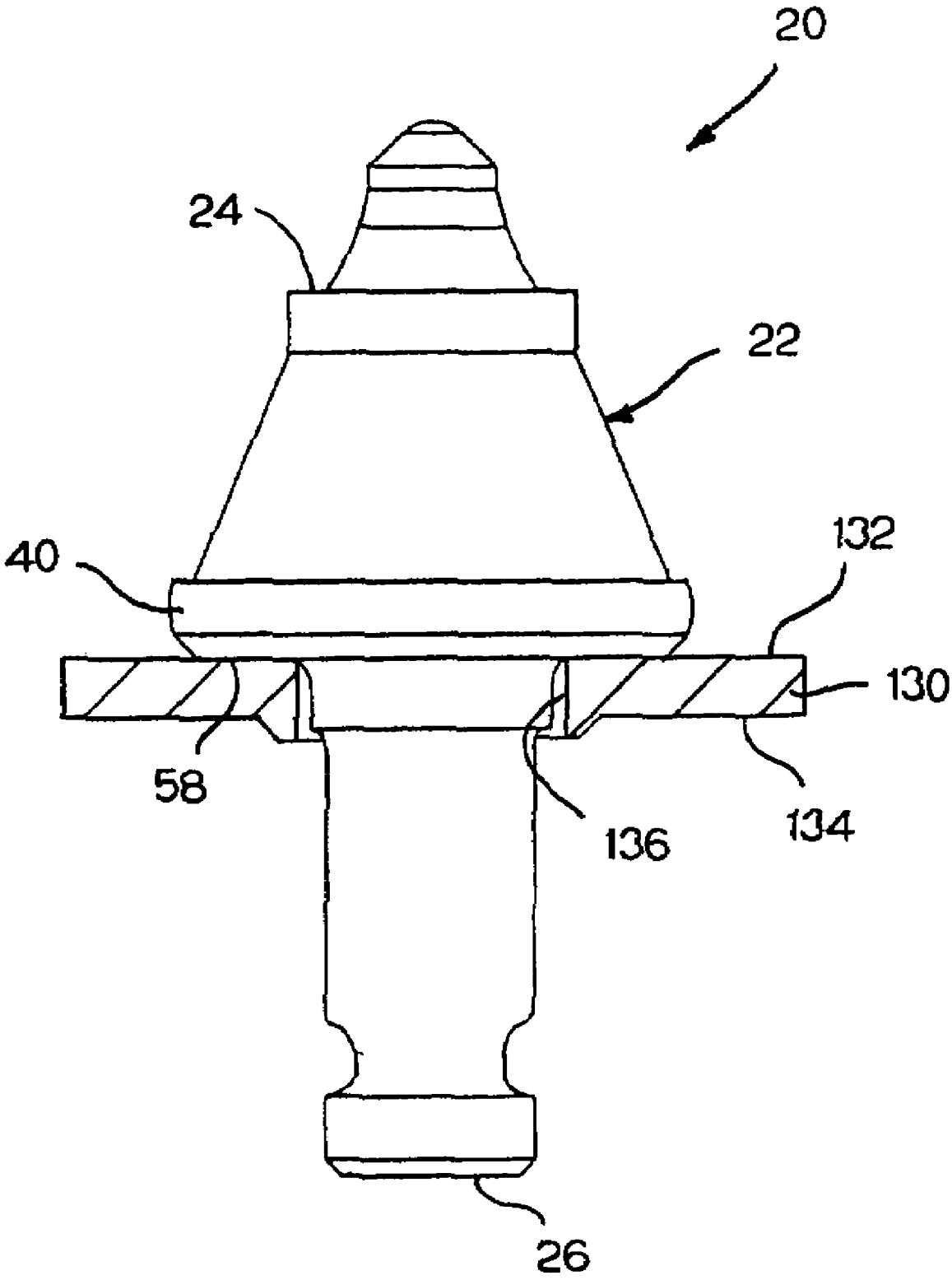
FIG. 3 is a side view of the specific embodiment of the rotatable cutting tool shown in FIG. 1, but further including a washer carried by the cutting tool body.

Referring to FIG. 3 and the operation of the rotatable cutting tools, this figure shows the rotatable cutting tool 20 with its corresponding washer 130 in operational position. When in this position, the washer 130 has its axial forward facing surface 132 is in contact with the axial rearward facing surface 58 of the collar portion 38. During operation, the bulk of the wear occurs at locations axial forward of the axial forward facing surface 132. In other words, the abrasive wear occurs on the head portion 32 and on the collar portion 38. Since all of the head portion 32 and the axial forward section of the collar portion 38 has a higher hardness, it can be appreciated that the portions of the cutting tool body 22 that experience the most wear also have the highest hardness. The same holds true with respect to the toughness. In this regard, the shank portion 44 experiences the greatest degree of stress during operation. Since the axial rearward hardness region encompasses all the shank portion, it can be appreciated that the portion of the cutting tool body 22 that experiences the greatest degree of stress also has the highest toughness.

In regard to the manufacturing steps to make a cutting tool body (22 or 72), the first step comprises the formation of the pre-treatment basic steel cutting tool body. The pre-treatment cutting tool body can be forged including the socket to receive the hard insert. One method of forging the steel cutting tool body is shown and described in pending U.S. patent application Ser. No. 11/259,183 filed on Oct. 26, 2005 for a Cold-Formed Rotatable Cutting Tool And Method Of Making The Same by Randall W. Ojanen, and assigned to Kennametal Inc., the assignee of the present patent application. In the alternative, the cutting tool body can be machined to the desired geometry including the puller groove and the socket that receives the hard insert.

The second step is to position the braze shim (and flux) and the hard insert in the socket. The entire assembly including all of the steel cutting tool body is then induction heated to braze the hard insert into the socket. The hot assembly is then quenched in a polymer solution to harden the entire cutting tool body to the minimum hardness value for the axial forward hardness region.

The third step is to induction heat only the axial rearward portion of the cutting tool body. The part is then air cooled to room temperature. Since the impact of the heating of the axial rearward portion diminishes in the axial forward direction, it can be appreciated that the hardness of the axial forward hardness region will not be impacted (i.e., reduced) while the hardness in the transition hardness region will be impacted (i.e., reduced) less than in the axial rearward hardness region. The hardness in the axial rearward hardness region will be impacted (or reduced) the most.

Figure 4:
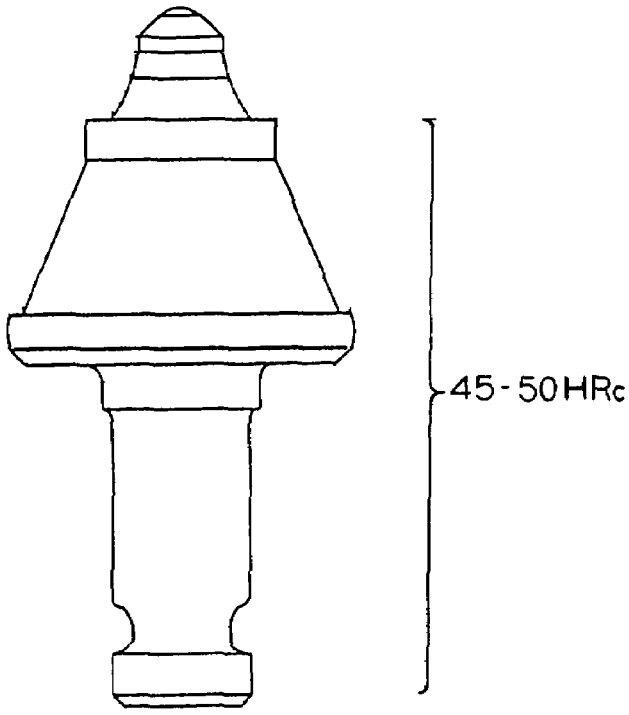
PRIOR ART FIG. 4
FIG. 4 is a side view of a first version of a PRIOR ART rotatable cutting tool.

FIG. 4 shows a prior art rotatable cutting tool that includes a cutting tool body. The cutting tool body is made from 15B37H Modified steel. The hardness of the rotatable cutting tool of FIG. 4 is within the range of 45-50 $HR_c$.

Figure 5:
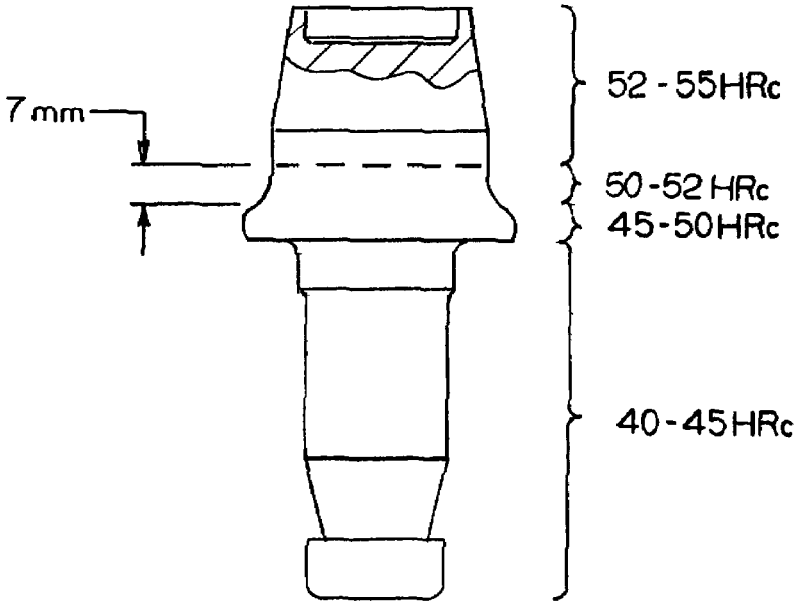
PRIOR ART FIG. 5
FIG. 5 is a side view of a second version of a PRIOR ART rotatable cutting tool.

FIG. 5 shows a prior art rotatable cutting tool that includes a cutting tool body. The cutting tool body is made from 30MnB4Ti steel. The hardness profile of the rotatable cutting tool of FIG. 5 exhibits four hardness regions a shown in FIG. 5. The first hardness region, which extends from the axial forward end to a location axial forward of (i.e., about 7 millimeters axial forward of) the collar, has hardness values within the range of 52-55 $HR_c$. The second hardness region, which extends from the juncture with the first hardness region to an axial rearward location as shown in the drawing, has hardness values within the range of 50-52 $HR_c$. The third hardness region comprises the collar and has hardness values within the range of 45-50 $HR_c$. Finally, the fourth hardness region extends from the rearward facing surface of the collar to the axial rearward end of the cutting tool body and has hardness values within the range of 40-45 $HR_c$.

One should appreciate that a difference between the prior art rotatable cutting tool body of FIG. 5 and the inventive cutting tool body (e.g., cutting tool body 22 and cutting tool body 72) is the extent to which the harder portion of the cutting tool body extends in an axial rearward direction from the axial forward end. In the inventive cutting tool body, the harder portion extends in the axial rearward direction to a greater extent than does the cutting tool body of FIG. 5. Such greater extension provides improved wear resistance for the cutting tool body, and hence, an increase in the useful tool life of the rotatable cutting tool.

In this regard, in the prior art FIG. 5 cutting tool body, the first hardness region extends from the axial forward end to a location about 7 millimeters axial forward of the collar. It is thus apparent that in the prior art tool body of FIG. 5, the first hardness region does not encompass the collar (or the section that presents the maximum diameter or transverse dimension) of the cutting tool body. This is in distinction to the present invention in which the axial forward hardness region 60 of cutting tool body 22 and axial forward hardness region 118 of cutting tool body 72 extend in the axial rearward direction such a distance to a location so that the axial forward hardness region encompasses the entire head portion and at least an axial forward section of the collar portion. It thus can be seen that in the inventive cutting tool body, the region of the highest hardness extends from the axial forward end to encompass the portion(s) of the cutting tool body that presents the maximum diameter (or transverse dimension).

Pursuant to this invention, Inventive Example 1 is a cutting tool body made from 15B37H Modified steel. The geometry of the cutting tool was along the lines of that shown in FIG. 1. Hardness measurements were taken at various locations along the axial length of cutting tool body. The hardness ranges for each of the hardness regions are set forth in Table 1 below.

TABLE 1

Hardness Values for Hardness (Rockwell C) of Inventive Example 1 (FIG. 1)

| Location | Hardness (HRC) |
|---|---|
| axial forward hardness region | Minimum 52 HRC |
| transition hardness region | 46-52 HRC |
| Axial rearward hardness region (axial forward of the middle of the retainer groove) | 40-46 HRC |
| Axial rearward hardness region (axial rearward of the middle of the retainer groove) | 38-48 HRC |

Pursuant to this invention, Inventive Example 2 is a cutting tool body made from 15B37H Modified steel. The geometry of the cutting tool was along the lines of that shown in FIG. 2. Hardness measurements were taken at various locations along the axial length of cutting tool body. The hardness ranges for each of the hardness regions are set forth in Table 2 below.

TABLE 2

Hardness Values for Hardness (Hardness Rockwell C) of Inventive Example 2 (FIG. 2)

| Location | Hardness (HRC) |
|---|---|
| axial forward hardness region | Minimum 52 HRC |
| transition hardness region | 46-52 HRC |
| Axial rearward hardness region (axial forward of the middle of the retainer groove) | 40-46 HRC |
| Axial rearward hardness region (axial rearward of the middle of the retainer groove) | 38-48 HRC |

It can be appreciated from the hardness values set forth in Table 1 and Table 2 that the entire head portion and the axial forward facing surface of the collar has a higher hardness, which provides for better wear resistance in the head portion that experiences abrasive wear. It can also be appreciated that the shank portion has a lower hardness, which provides for better toughness in the shank region that experiences stresses under severe operating environments.

It should be appreciated that the present invention provides a cutting tool body that exhibits improved resistance to abrasive wear. A more wear-resistant cutting tool body is better able to withstand severe wear conditions, and thereby is less likely to experience premature failure due to premature (or excessive) wear.

In order to provide an improved useful tool life, it would be desirable to provide a cutting tool body that exhibits improved toughness. A tougher cutting tool body is better able to withstand severe operating conditions, and thereby is less likely to experience premature failure (e.g., catastrophic stress fracturing) due to operational stress.

As one can appreciate, if a cutting tool body does not exhibit sufficient wear resistance or toughness there exists the risk that the cutting tool body may prematurely fail. Such a premature failure of the cutting tool body is an undesirable result that typically leads to the termination of the useful life of the rotatable cutting tool, as well as a decrease in the operational efficiency of the road milling machine. It thus is apparent that it would be very desirable to provide an improved rotatable cutting tool that has an improved cutting tool body wherein the cutting tool body exhibits improved wear resistance and improved toughness.

The patents and other documents identified herein are hereby incorporated by reference herein.

Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. An elongate rotatable cutting tool body with a central longitudinal axis, the tool body comprising:

an axial forward end and an axial rearward end;

a head portion, a shank portion and a collar portion, and the collar portion being mediate of and contiguous with the head portion and the shank portion;

the head portion being adjacent to the axial forward end, and the shank portion being adjacent to the axial rearward end;

the cutting tool body being made of steel having a nominal composition comprising 0.33-0.38 weight percent carbon, a minimum of 0.0005 weight percent boron, 1.10-1.35 weight percent manganese, 0.15-0.30 weight percent silicon, a maximum of 0.045 weight percent sulfur, a maximum of 0.035 weight percent phosphorus, and balance of iron;

an axial forward hardness region beginning at and extending a first pre-selected distance in an axial rearward direction from the axial forward end to encompass the entire head portion and at least an axial forward section of the collar portion, the axial forward hardness region having a hardness equal to or greater than a first hardness wherein the first hardness is equal to 52 Rockwell C, and the axial forward hardness region having a first average hardness wherein the first average hardness is greater than 52 Rockwell C;

an axial rearward hardness region beginning at and extending a second pre-selected distance in an axial forward direction from the axial rearward end to encompass an axial rearward section of the shank portion, and the axial rearward hardness region having a third average hardness;

a transition hardness region mediate of and contiguous with the axial forward hardness region and the axial rearward hardness region, the transition hardness region encompasses an axial rearward section of the collar portion and an axial forward section of the shank portion, and the transition hardness region having a second average hardness; and the second average hardness being less than the first hardness, and the third average hardness being less than the second average hardness.

2. The rotatable cutting tool body of claim 1 wherein the hardness of the axial forward hardness region generally deceases in the axial rearward direction.

3. The rotatable cutting tool body of claim 1 wherein the hardness of the transition hardness region generally deceases in the axial rearward direction.

4. The rotatable cutting tool body of claim 1 wherein the hardness of the axial rearward hardness region generally decease in the axial rearward direction.

5. The rotatable cutting tool body of claim 1 wherein the axial forward hardness region has greater wear resistance than the axial rearward hardness region, and the axial rearward hardness region has greater toughness than the axial forward hardness region.

6. An elongate rotatable cutting tool body having a central longitudinal axis, the cutting tool body comprising:

an axial forward end and an axial rearward end;

the cutting tool body having an enlarged diameter collar mediate of the axial forward end and the axial rearward end, and the mediate collar presenting an axial forward facing surface and an axial rearward facing surface;

the cutting tool body being made of steel having a composition comprising 0.33-0.38 weight percent carbon, a minimum of 0.0005 weight percent boron, 1.10-1.35 weight percent manganese, 0.15-0.30 weight percent silicon, a maximum of 0.045 weight percent sulfur, a maximum of 0.035 weight percent phosphorus, and balance of iron;

the cutting tool body having an axial forward hardness region beginning at and extending a first pre-selected distance in an axial rearward direction from the axial forward end to encompass the axial forward facing surface of the collar, the axial forward hardness region having a hardness equal to or greater than a first hardness wherein the first hardness is equal to 52 Rockwell C, and the axial forward hardness region having a first average hardness wherein the first average hardness is greater than 52 Rockwell C;

an axial rearward hardness region beginning at and extending a second pre-selected distance in an axial forward direction from the axial rearward end to encompass an axial rearward section of the shank portion, and the axial rearward hardness region having a third average hardness;

a transition hardness region mediate of and contiguous with the axial forward hardness region and the axial rearward hardness region, the transition hardness region encompasses the axial rearward facing surface of the collar and an axial forward section of the shank portion, and the transition hardness region having a second average hardness; and the second average hardness being less than the first hardness, and the third average hardness being less than the second average hardness.

7. The rotatable cutting tool body of claim 6 wherein the hardness of the axial forward hardness region generally deceases in the axial rearward direction.

8. The rotatable cutting tool body of claim 6 wherein the hardness of the transition hardness region generally deceases in the axial rearward direction.

9. The rotatable cutting tool body of claim 6 wherein the hardness of the axial rearward hardness region generally decease in the axial rearward direction.

10. The rotatable cutting tool body of claim 6 wherein the axial forward hardness region has greater wear resistance than the axial rearward hardness region, and the axial rearward hardness region has greater toughness than the axial forward hardness region.

11. A rotatable cutting tool carried in a bore of a holder wherein the holder has a forward surface surrounding a forward end of the bore, the rotatable cutting tool comprising:

an elongate cutting tool body having a central longitudinal axis, an axial forward end and an axial rearward end, and the cutting tool body containing a socket in the axial forward end thereof, and the socket receiving a hard insert therein;

the cutting tool body having an enlarged diameter collar mediate of the axial forward end and the axial rearward end, and the mediate collar presenting an axial forward facing surface and an axial rearward facing surface;

the cutting tool body being made of steel having a maximum as-quenched hardness;

the cutting tool body having an axial forward hardness region beginning at and extending a first pre-selected distance in an axial rearward direction from the axial forward end to encompass the axial forward facing surface of the collar, the axial forward hardness region having a hardness equal to or greater than a first hardness wherein the first hardness is at least about 91.2 percent of the maximum as-quenched hardness, and the axial forward hardness region having a first average hardness;

an axial rearward hardness region beginning at and extending a second pre-selected distance in an axial forward direction from the axial rearward end to encompass an axial rearward section of the shank portion, and the axial rearward hardness region having a third average hardness;

a transition hardness region mediate of and contiguous with the axial forward hardness region and the axial rearward hardness region, the transition hardness region encompasses the axial rearward facing surface of the collar and an axial forward section of the shank portion, and the transition hardness region having a second average hardness; and the second average hardness being less than the first hardness, and the third average hardness being less than the second average hardness.

12. The rotatable cutting tool of claim 11 wherein the hardness of the axial forward hardness region generally deceases in the axial rearward direction.

13. The rotatable cutting tool of claim 11 wherein the hardness of the transition hardness region generally deceases in the axial rearward direction.

14. The rotatable cutting tool of claim 11 wherein the hardness of the axial rearward hardness region generally decease in the axial rearward direction.

15. The rotatable cutting tool of claim 11 wherein the axial forward hardness region has greater wear resistance than the axial rearward hardness region, and the axial rearward hardness region has greater toughness than the axial forward hardness region.

16. The rotatable cutting tool of claim 11 wherein the first average hardness is greater than about 91.2 percent of the maximum as-quenched hardness.

* * * * *